US007955442B2

(12) United States Patent
Hidaka et al.

(10) Patent No.: US 7,955,442 B2
(45) Date of Patent: Jun. 7, 2011

(54) METHOD FOR PRODUCING SINTERED MAGNET AND ALLOY FOR SINTERED MAGNET

(75) Inventors: Tetsuya Hidaka, Tokyo (JP); Chikara Ishizaka, Tokyo (JP)

(73) Assignee: TDK Corporation (JP)

( * ) Notice: Subject to any disclaimer, the term of this patent is extended or adjusted under 35 U.S.C. 154(b) by 586 days.

(21) Appl. No.: 10/990,333

(22) Filed: Nov. 16, 2004

(65) Prior Publication Data

US 2005/0183791 A1 Aug. 25, 2005

(30) Foreign Application Priority Data

Nov. 18, 2003 (JP) ..... 2003-387672

(51) Int. Cl.
*H01F 1/057* (2006.01)

(52) U.S. Cl. ..... 148/103; 148/101

(58) Field of Classification Search ..... None
See application file for complete search history.

(56) References Cited

U.S. PATENT DOCUMENTS

| | | | | |
|---|---|---|---|---|
| 4,837,114 | A * | 6/1989 | Hamada et al. | 427/527 |
| 5,383,978 | A * | 1/1995 | Yamamoto et al. | 148/101 |
| 2001/0015239 | A1* | 8/2001 | Kanekiyo | 148/104 |
| 2003/0019546 | A1* | 1/2003 | Kanekiyo et al. | 148/105 |
| 2003/0098094 | A1* | 5/2003 | Hasegawa et al. | 148/302 |
| 2003/0136468 | A1* | 7/2003 | Kanekiyo et al. | 148/101 |
| 2003/0183305 | A1* | 10/2003 | Murakami et al. | 148/302 |

FOREIGN PATENT DOCUMENTS

| | | |
|---|---|---|
| EP | 0 633 581 | 11/1995 |
| JP | 59-217304 | 12/1984 |
| JP | 02-247307 | 10/1990 |
| JP | 03-130310 | 6/1991 |
| JP | 06-220502 | 8/1994 |
| JP | 08-148318 | 6/1996 |
| JP | 09-289127 | 11/1997 |
| JP | 10-084138 | 3/1998 |
| JP | 11-050110 | 2/1999 |
| JP | 2000-223306 | 8/2000 |
| JP | 2000-286115 | 10/2000 |
| JP | 2000-355708 | 12/2000 |
| JP | 2002-033207 | 1/2002 |
| JP | 2002-329604 | 11/2002 |

OTHER PUBLICATIONS

ASM Material Engineering Dictionary, Edited by J. R. Davis 1992, p. 239.*

Chinese language office action and its English translation for corresponding Chinese application No. 2004100947629 provides a statement of relevancy for Chinese document No. 107115.

* cited by examiner

*Primary Examiner* — John P Sheehan

(74) *Attorney, Agent, or Firm* — Dariush G. Adli; Adli Law Group P.C.

(57) ABSTRACT

The present invention provides a method for producing a sintered magnet, which can have a sufficient sintered density even when the magnet has a low-R composition. The method is for producing a sintered magnet comprising R (R: one or more rare-earth elements), T (T: one or more transition metal elements essentially comprising Fe, or Fe and Co) and B (boron) as the main components, wherein a starting alloy prepared by strip casting is pulverized to a given particle size to form a fine powder, where the starting alloy comprises discolored deposit 1 on the surface and the area ratio of the discolored deposit 1 is 1.5% or less, the resulting fine powder is compacted in a magnetic field to prepare a compact, and the compact is sintered.

8 Claims, 3 Drawing Sheets

| Area Ratio of Discolored Deposit [%] | Sintered Density [Mg/m$^3$] | Oxygen Content of Sintered Body [ppm] | Remarks |
|---|---|---|---|
| 2.1 | 7.20～7.30 | 920 | Comparative Example |
| 1.8 | 7.31～7.37 | 740 | |
| 1.4 | 7.39～7.44 | 710 | Example |
| 0.9 | 7.44～7.47 | 510 | |
| 0.2 | 7.48～7.50 | 480 | |

FIG. 2

| Area Ratio of Discolored Deposit [%] | Sintered Density [$Mg/m^3$] | Oxygen Content of Sintered Body [ppm] | Remarks |
|---|---|---|---|
| 2.1 | 7.20～7.30 | 920 | Comparative Example |
| 1.8 | 7.31～7.37 | 740 | |
| 1.4 | 7.39～7.44 | 710 | Example |
| 0.9 | 7.44～7.47 | 510 | |
| 0.2 | 7.48～7.50 | 480 | |

FIG. 3

| Area Ratio of Discolored Deposit [%] | Sintered Density [$Mg/m^3$] | Oxygen Content of Sintered Body [ppm] | Remarks |
|---|---|---|---|
| 2.2 | 7.30～7.35 | 930 | Comparative Example |
| 1.7 | 7.35～7.39 | 720 | |
| 1.3 | 7.39～7.45 | 700 | Example |
| 0.8 | 7.45～7.48 | 500 | |
| 0.4 | 7.48～7.50 | 490 | |

METHOD FOR PRODUCING SINTERED MAGNET AND ALLOY FOR SINTERED MAGNET

BACKGROUND OF THE INVENTION

1. Field of the Invention

The present invention relates to a rare-earth magnet, in particular relates to a starting alloy for an R-T-B system sintered magnet comprising a rare-earth element (R), one or more transition metal elements (T) essentially comprising Fe, or Fe and Co, and boron (B) as the main components.

2. Description of the Related Art

An R-T-B system sintered magnet has advantages of excellent magnetic properties, and relatively low cost because Nd as the main component is an abundant resource. It is produced by powder metallurgy comprising the following main steps. First, a starting alloy is prepared by melting a given composition of the components; the alloy is crushed to a given particle size; and the resulting powder is compacted into a shape in a magnetic field, and sintered and thermally treated.

The starting alloy is frequently produced by strip casting, where it is quenched on the rotating rolls. When the starting alloy produced by strip casting is treated for hydrogen crushing, hydrogen absorption time including that for activation treatment, crushing time and crushability in the presence of hydrogen largely disperse lot by lot, as disclosed by Japanese Patent Laid-Open No. 11-50110. This document discusses that the dispersions are caused by the following phenomenon. An R-T-B system alloy is mainly composed of $R_2Fe_{14}B$ as the main phase and grain boundary phase (R-rich phase) both having a high affinity for oxygen, with the result that an oxide film and/or slug is formed on the contact surface on the roll even when it is melted and solidified in an Ar gas atmosphere, for example, in the strip casting to retard adsorption of hydrogen molecules on the alloy base.

Japanese Patent Laid-Open No. 11-50110 proposes acid treatment to remove the oxide film and/or slug on the starting alloy surfaces, to greatly improve hydrogen absorption efficiency of a starting alloy produced by strip casting (hereinafter sometimes referred to as SC alloy).

SUMMARY OF THE INVENTION

Rare-earth element content has been set at a low level for an R-T-B system sintered magnet to meet requirements for improved magnetic properties. However, it is sometimes observed that the composition of low rare-earth element content (hereinafter sometimes referred to as low-R composition) cannot be sintered sufficiently to have an intended density. Although it is known that adopting such a low-R composition leads to decrease in sinterability, but low level of sintered density is far beyond our expectations. The inventors of the present invention have found that the lowered sinterability is caused by a discolored deposit, which is described in detail later. It is difficult to remove by the acid treatment, proposed by Japanese Patent Laid-Open No. 11-50110.

The present invention has been developed to solve these technical problems. It is an object of the present invention to provide a method for producing a sintered magnet, which can control a decrease in sinterability.

The inventors of the present invention observed surface conditions of the SC alloy to find that a substance bearing a color different from that of the alloy itself deposits on the surface. The deposit is hereinafter referred to as discolored deposit in this specification. FIG. 1 is a photograph showing the outer appearance of the SC alloy, where the portions marked with "1" represent the discolored deposits. They are considered to result from the oxide film and/or slug formed on the melt surface in the strip casting. The discolored deposit is about 0.1 μm thick on the average and around 0.4 μm thick at a maximum, and is not easy to remove by acid treatment. It is found on a free surface of the SC alloy, which means the surface on the side not in contact with the quenching roll.

The discolored deposit 1 is inevitably formed on the SC alloy. The present inventors have confirmed that sinterability can be improved by controlling the quantity of the discolored deposit 1 than otherwise. This effect is more notable for low-R compositions.

The method of the present invention, developed based on the above finding, is for producing a sintered magnet comprising R (R: one or more rare-earth elements), T (T: one or more transition metal elements essentially comprising Fe, or Fe and Co) and B (boron) as the main components, wherein a starting alloy prepared by strip casting is pulverized to a given particle size to forma fine powder, where the starting alloy comprises a discolored deposit on the surface and the area ratio of the discolored deposit is 1.5% or less, the fine powder is compacted in a magnetic field to prepare a compact, and the compact is sintered.

The discolored deposit has preferably an area ratio of 1.0% or less, more preferably of 0.5% or less.

In the method of the present invention for producing a sintered magnet, the starting alloy melt is preferably held in an atmosphere with controlled oxygen partial pressure in the strip casting, because formation of the discolored deposit is controlled in such an atmosphere. The discolored deposit is formed on a surface of the alloy that is not in contact with the cooling roll (free surface) used in the strip casting, and differs from the oxide film and/or slag described in Japanese Patent Laid-Open No. 11-50110.

The strip casting atmosphere can be controlled to have an oxygen partial pressure of 0.50 Pa or less.

The starting alloy preferably has a mean grain size of 1 to 50 μm and thickness of 0.02 to 3 mm, for example.

The present invention can produce a sintered magnet having a composition of R: 27.0 to 40.0% by weight, B: 0.5 to 4.5% by weight and T: balance, for example.

The present invention is particularly effective for a sintered magnet of low-R composition containing R at 27.0 to 31.0% by weight, knowing that decrease in sinterability is notably observed with a low-R composition.

The present invention can secure a sufficient sintered density, even when applied to a low-R composition.

BRIEF DESCRIPTION OF THE DRAWINGS

FIG. 2 is a table showing the area ratio of the discolored deposit, sintered density and oxygen content in the sintered bodies obtained in Example 1.

FIG. 3 is a table showing the area ratio of the discolored deposit, sintered density and oxygen content in the sintered bodies obtained in Example 2.

DETAILED DESCRIPTION OF THE PREFERRED EMBODIMENTS

Figure 1:
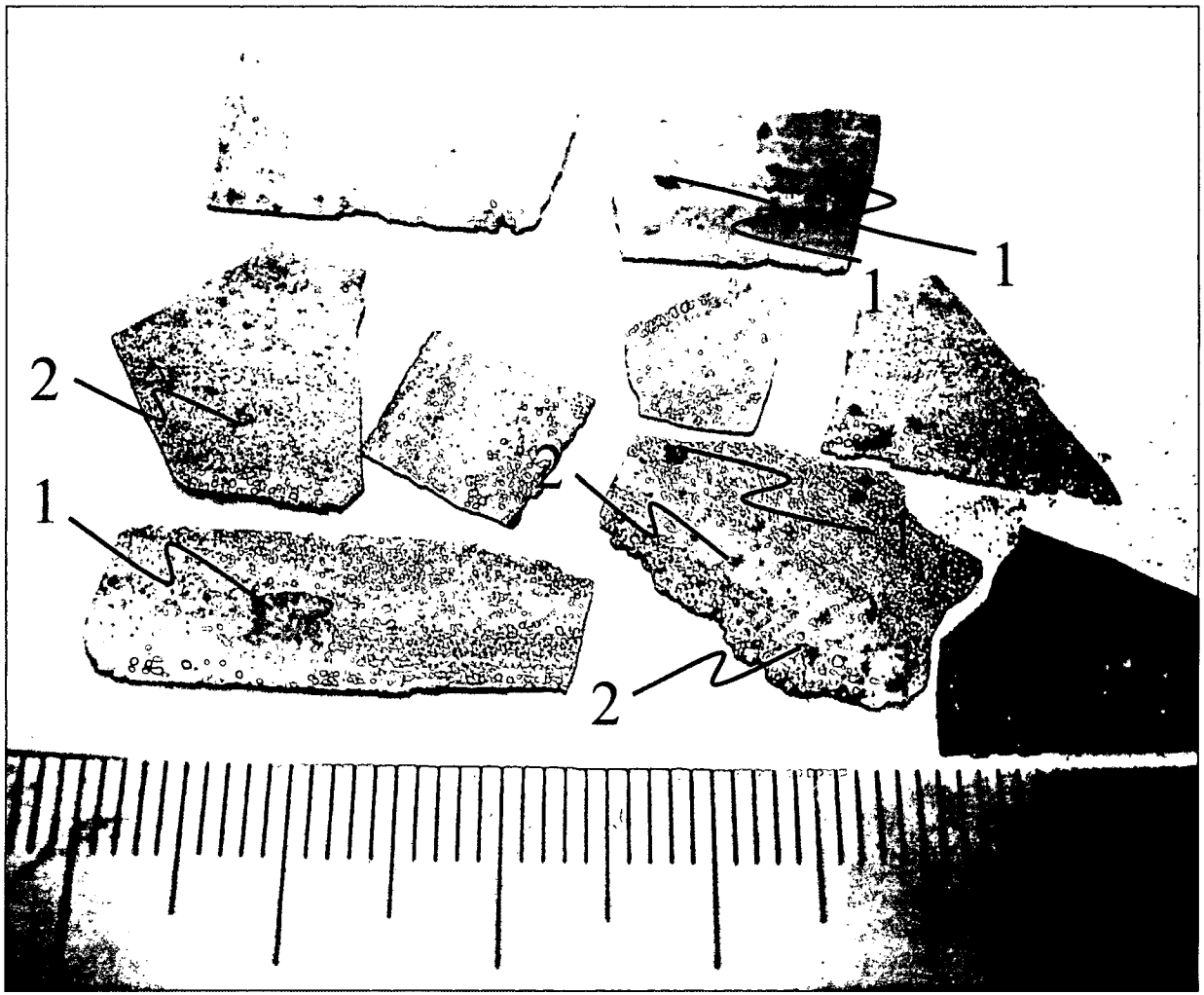
FIG. 1 shows outer appearances of the SC alloy.

The preferred embodiments of the present invention will be described below.

The starting alloy of the present invention for producing rare-earth magnets is prepared by strip casting, where the starting metals are melted in a non-oxidative atmosphere, e.g., an Ar gas atmosphere, and the resulting melt is sprayed onto a rotating roll. The melt quenched by the roll is solidified into the alloy in a thin plate or flaky shape. It has a uniform microstructure with the mean grain size of 1 to 50 μm.

Moreover, the quenched/solidified alloy is preferably 0.05 to 3 mm thick, and has a metallic microstructure dispersed with the R-rich phase finely divided to 5 μm or less, in order to narrow particle size distribution of the alloy to be crushed subsequently and thereby improve the magnetic properties.

It is considered that the discolored deposit as the major concern for the present invention is formed while the alloy is melted. The alloy melt is held in a tundish in a non-oxidative atmosphere. It is however difficult to realize a completely non-oxidative atmosphere in a commercial production system. Moreover, the melt contains an active rare-earth element. As a result, an oxide film is formed on the melt surfaces. The inventors of the present invention understand that the discolored deposit is formed when the oxide film caught in the melt is cooled on the roll surfaces. Quantity of the formed discolored deposit may be controlled by controlling formation of the oxide film on the melt surfaces, because it is caused by the oxide film formed on the alloy melt. It is therefore possible to control formation of the oxide film, and hence control the quantity of the formed discolored deposit, by keeping oxygen partial pressure at a low level in the atmosphere over the alloy melt. The oxygen partial pressure is kept at 0.50 Pa or less, preferably 0.28 Pa or less, more preferably 0.14 Pa or less.

Decrease in sintered density can be controlled by keeping the discolored deposit at an area ratio of 1.5% or less, as discussed later in Examples. The area ratio is preferably 1% or less, more preferably 0.5% or less.

The fine projections 2 (hereinafter sometimes referred to as projections 2), shown in FIG. 1, are formed in addition to the discolored deposits on the free surface of the SC alloy. These projections 2 are considered to deteriorate alloy sinterability, because of an oxide contained in the projections 2. Therefore, it is also desired to control formation of these projections 2. The inventors of the present invention have also found that keeping the atmosphere in which the alloy melt is held at a low oxygen partial pressure to control formation of the discolored deposit 1 (hereinafter sometimes referred to as deposit 1) also controls formation of these projections 2.

Reduced area ratio of the discolored deposit can be achieved by mechanically removing the deposit 1 later, in addition to decreasing the oxygen partial pressure of the atmosphere in which the alloy melt is held. The starting alloy may be treated to remove portions in which the deposit 1 is formed. The SC alloy is normally crushed to several millimeters to several centimeters for ease of transportation, and the portions having the deposit 1 can be screened out from the crushed SC alloy. The screening may be performed visually, or based on thickness.

The starting alloy of the present invention for producing rare-earth magnets is for R-T-B system sintered magnets, and should have a composition substantially similar to that of the R-T-B system sintered magnet for which it is used. The composition is specifically selected depending on purposes of the magnet. However, it normally has a composition of R: 27.0 to 40.0% by weight, B: 0.5 to 4.5% by weight and T: balance, for example. R for the present invention has a concept that includes Y, and is at least one element selected from the group consisting of La, Ce, Pr, Nd, Sm, Eu, Gd, Tb, Dy, Ho, Er, Yb, Lu and Y. At an R content below 27.0% by weight, the $R_2Fe_{14}B$ phase as the main phase of a permanent rare-earth magnet may not be sufficiently formed to greatly deteriorate magnet coercive force because of separation of soft magnetic α-Fe or the like. On the other hand, at an R content above 40% by weight, the residual flux density of the magnet tends to decreased, because of decreased volumetric content of the $R_2Fe_{14}B$ phase as the main phase. Moreover, R reacts with oxygen to increase the oxygen content of the magnet, thereby coercive force will be decreased, because of reduced content of the R-rich phase, which effectively works to produce coercive force. Therefore, the R content should be in a range from 27.0 to 40.0% by weight. R representing rare-earth element is preferably composed of Nd as a main component, because it is an abundant resource and available at a relatively low cost. The present invention is particularly effective for a low-R composition having an R content of 27.0 to 31.0% by weight, in particular 27.0 to 30.0% by weight.

A magnet may not exhibit a high coercive force at a boron B content below 0.5% by weight. At a boron B content above 4.5% by weight, on the other hand, the residual flux density of the magnet tends to be decreased. Therefore, the upper limit of B content should be set at 4.5% by weight. B content is preferably in a range from 0.5 to 1.5% by weight.

In order to improve coercive force, the alloy composition may further comprise M to give an R-T-B-M system permanent rare-earth magnet, where M represents at least one element selected from the group consisting of Al, Cr, Mn, Mg, Si, Cu, C, Nb, Sn, W, V, Zr, Ti, Mo, Bi, Ag and Ga.

The present invention is described for producing a rare-earth permanent magnet using a starting alloy of single composition. However, it is applicable to production of a rare-earth permanent magnet using two or more starting alloys of different composition.

Next, the method for producing an R-T-B system sintered magnet using the starting alloy of the present invention for rare-earth magnets is described.

The starting alloy of the present invention for rare-earth magnets comprises an intermetallic compound of $R_2Fe_{14}B$, which is difficult to crush, and is preferably treated to absorb hydrogen to facilitate crushing.

The starting alloy can absorb hydrogen when exposed to a hydrogen-containing atmosphere at room temperature. The hydrogen-absorbing reaction is exothermic, and a reactor used therefor may be provided with a cooling means to prevent decreased reaction rate as temperature rises. The starting alloy which absorbs hydrogen will be cracked, e.g., along the grain boundaries.

After the starting alloy is treated to absorb hydrogen, it is kept at an elevated temperature for dehydrogenation to reduce the hydrogen, which is an impurity for a magnet. The dehydrogenation temperature is 200° C. or higher, preferably 350° C. or higher. The period of dehydrogenation may vary depending on the dehydrogenation temperature, the thickness of the SC alloy or the like, but should be 30 minutes or more, preferably 1 hour or more. The dehydrogenation treatment is carried out under a vacuum or in a flow of an Ar gas. This treatment, however, is not essential.

The SC alloy undergoing the hydrogen-absorbing treatment (and subsequent dehydrogenation treatment, when carried out) is pulverized by a jet mill to a mean particle size of around 1 to 10 μm in a non-oxidative atmosphere containing oxygen at 100 ppm or less, preferably 50 ppm or less, to prevent increase in oxygen content of the alloy.

The resulting fine powders are then compacted into a shape in a magnetic field. This step may be carried out at an intensity of around 12 to 20 kOe (960 to 1600 kA/m) and a pressure of around 0.3 to 3.0 t/cm$^2$ (30 to 300 MPa).

The obtained compact is sintered under a vacuum or in a non-oxidative atmosphere. It may be sintered at 1000 to 1100° C. for 1 to 10 hours, although sintering temperature should be set in consideration of various conditions, e.g., alloy composition, crushing method, mean particle size and particle size distribution. The compact may be treated to remove a crushing agent and gases contained therein prior to sintering. The resulting sintered body may be treated for aging, which is an important step for controlling its coercive force. When the aging treatment is carried out in two stages, the effective temperature levels are around 800° C. and around 600° C. kept for a given time. The sintered body has an improved coercive force when treated at around 800° C., and a more improved coercive force when treated at around 600° C. It is recommended, therefore, to carry out the one-stage aging treatment at around 600° C.

The sintered body is preferably coated with a protective film, because an R-T-B system sintered magnet is not resistant to corrosion. The method for forming the protective film may be selected from known ones in consideration of the film type. For example, when electroplating is adopted, it may be formed by the following steps by the common procedure:

Working of the sintered body→Barreling→Degreasing→Water washing→Etching (e.g., with nitric acid)→Water washing→Electroplating for forming the film→Water washing→Drying

EXAMPLE 1

The present invention is described more specifically by Examples.

An SC alloy, having a composition of Nd: 27.55%, B: 1.02%, Cu: 0.04% and Fe: balance, was prepared, where all percentages are by weight. This composition corresponds to the low-R composition for improving magnetic properties. A total of 5 types of SC alloys with different oxygen contents were prepared by changing oxygen partial pressure of the atmosphere in which the alloy melt was held. The SC alloys were each around 320 μm thick. They were measured for area ratio of the discolored deposit. The results are given in FIG. 2. As shown, area ratio of the discolored deposit is confirmed to increase as oxygen content increases. The area ratio was determined by observing a surface area roughly corresponding to an A-4 size on the free SC alloy surface.

Each of the SC alloys was treated to absorb hydrogen and then crushed by a jet mill to have fine powders of 5.8 to 6.0 μm in mean particle size. The fine powders were compacted into a shape in a magnetic field of around 1500 kA/m under a pressure of 49 MPa by a pressing machine in an atmosphere whose oxygen concentration was controlled at 100 ppm or less. The resulting compact was sintered at 1030° C. for 30 hours while keeping it away from the atmosphere. The sintered body was measured for density. The results are shown in FIG. 2 (average of the set of 4 samples).

As shown, the sintered body tends to have a high density and reduced density dispersion when the discolored deposit is controlled at an area ratio of 1.5% or less.

FIG. 2 also shows oxygen content of the sintered body (average of the 4 samples). The oxygen content decreases as sintered density increases, from which it is judged that increased sintered density results from reduced quantity of the discolored deposit, which decreases oxygen content.

EXAMPLE 2

The sintered bodies were prepared in the same manner as in Example 1, except that the SC alloy was replaced by the one having a composition of Nd: 29.10%, B: 1.04%, Cu: 0.04% and Fe: balance, where all percentages are by weight. The results of sintered density and oxygen content are shown in FIG. 3.

As shown in FIG. 3, the sintered body tends to have a high density and reduced density dispersion when the discolored deposit is controlled at an area ratio of 1.5% or less, as is the case with Example 1. It is also noted that sintered density decreases less at a high area ratio of the discolored deposit than that observed in Example 1, which used a lower-R composition.

As observed in Examples, the alloy of the present invention enables stable production of the sintered magnets.

What is claimed is:

1. A method for producing a sintered magnet comprising R (R: one or more rare-earth elements), T (T: one or more transition metal elements essentially comprising Fe, or Fe and Co) and B (boron) as the main components, wherein:

strip casting a starting alloy, the strip casted starting alloy comprises a discolored deposit on a surface, decreasing the area ratio of said discolored deposit to 1.5% or less, by mechanically removing or screening out the discolored deposit from the strip casted starting alloy, pulverizing the strip casted starting alloy with the area ratio of said discolored deposit being 1.5% or less, by a jet mill in a non-oxidative atmosphere containing oxygen at 100 ppm or less to a given particle size to form a fine powder, wherein said fine powder is compacted in a magnetic field to prepare a compact, and said compact is sintered, and wherein R is contained in said sintered magnet in a range from 27.0 to 30.0% by weight of R.

2. The method according to claim 1 for producing a sintered magnet, wherein:

the strip casted starting alloy has a mean grain size of 1 to 50 μm.

3. The method according to claim 1 for producing a sintered magnet, wherein:

the strip casted starting alloy is 0.02 to 3 mm thick.

4. The method according to claim 1 for producing a sintered magnet, wherein:

said discolored deposit has an area ratio of 1.0% or less.

5. The method according to claim 1 for producing a sintered magnet, wherein:

said discolored deposit has an area ratio of 0.5% or less.

6. The method according to claim 1 for producing a sintered magnet, wherein:

said sintered magnet has a composition of 27.0 to 30.0% by weight of R, 0.5 to 4.5% by weight of B and the balance of T.

7. The method according to claim 1 for producing a sintered magnet, wherein:

said starting alloy is prepared by strip casting while being kept melted in an atmosphere with a controlled oxygen partial pressure, and wherein said oxygen partial pressure is controlled at 0.50 Pa or less, excluding zero.

8. The method according to claim 1 for producing a sintered magnet, wherein:

said discolored deposit is present on a surface that is not in contact with a cooling roll used for strip casting.

* * * * *